US012742293B2

(12) United States Patent
Fountain et al.

(10) Patent No.: US 12,742,293 B2
(45) Date of Patent: Sep. 22, 2026

(54) PROCESS AND SYSTEM FOR MANUFACTURING A FIBREBOARD FROM WASTE MATERIALS

(71) Applicant: Unwasted Limited, London (GB)

(72) Inventors: Rod Fountain, Bookham (GB); Robert Langley, Princes Risborough (GB)

( * ) Notice: Subject to any disclaimer, the term of this patent is extended or adjusted under 35 U.S.C. 154(b) by 598 days.

(21) Appl. No.: 17/441,382

(22) PCT Filed: Mar. 20, 2020

(86) PCT No.: PCT/IB2020/052637
§ 371 (c)(1),
(2) Date: Sep. 21, 2021

(87) PCT Pub. No.: WO2020/188541
PCT Pub. Date: Sep. 24, 2020

(65) Prior Publication Data

US 2022/0178081 A1 Jun. 9, 2022

(30) Foreign Application Priority Data

Mar. 21, 2019 (GB) ..... 1903928

(51) Int. Cl.
*D21J 1/04* (2006.01)
*D21J 1/06* (2006.01)
*D21J 3/12* (2006.01)

(52) U.S. Cl.
CPC . *D21J 1/04* (2013.01); *D21J 1/06* (2013.01); *D21J 3/12* (2013.01)

(58) Field of Classification Search
CPC ..... D21J 1/04; D21J 1/06; D21J 3/12
See application file for complete search history.

(56) References Cited

U.S. PATENT DOCUMENTS

2004/0256071 A1* 12/2004 Huhtamaki ..... D21B 1/026 162/189
2012/0187226 A1* 7/2012 Tarverdi ..... D21B 1/30 29/527.1

(Continued)

FOREIGN PATENT DOCUMENTS

EP 2922906 B1 10/2018
JP H10121400 A 5/1998

(Continued)

OTHER PUBLICATIONS

Combined Search and Examination Report under Section 17 and 18(3) issued in GB Application No. GB1903928.8 on Apr. 23, 2019, 5 pages.

(Continued)

*Primary Examiner* — Abbas Rashid
*Assistant Examiner* — Stephen M Russell
(74) *Attorney, Agent, or Firm* — RC Trademark Company

(57) ABSTRACT

There is disclosed a process of manufacturing a fibreboard from a waste material, for example from a corrugated waste material, wherein the process comprises: refining in a range of 5 to 30 percent of the waste material into micro-fibrillated cellulose (MFC), using a mechanical micro-fibrillation process; pulping in a range of 70 to 95 percent of the waste material with water to obtain a waste pulp; dispersing the micro-fibrillated cellulose (MFC) into the waste pulp to obtain a micro-fibrillated waste pulp; moulding the micro-fibrillated waste pulp by applying a pressure to obtain a moulded fibreboard, using a moulding process; and drying the moulded fibreboard at a temperature to obtain the fibreboard with a density in a range of 500 to 1000 kilograms per cubic metre (kg/m$^3$), for example in a range of 650 to 850 kilograms per cubic metre (kg/m$^3$).

7 Claims, 7 Drawing Sheets

(56) References Cited

U.S. PATENT DOCUMENTS

| | | | | |
|---|---|---|---|---|
| 2016/0032531 | A1* | 2/2016 | Husband | D21H 17/68 162/157.6 |
| 2016/0145805 | A1* | 5/2016 | Kroener | D21H 21/36 162/4 |
| 2016/0257814 | A1* | 9/2016 | Schade | D21B 1/00 |
| 2017/0072670 | A1 | 3/2017 | Tajvidi et al. | |
| 2018/0230286 | A1 | 8/2018 | Stubblefield et al. | |
| 2020/0207663 | A1* | 7/2020 | Cai | C04B 28/06 |

FOREIGN PATENT DOCUMENTS

| | | | |
|---|---|---|---|
| JP | 2018059236 | A | 4/2018 |
| JP | 2018115416 | A | 7/2018 |
| WO | 2013160553 | A1 | 10/2013 |
| WO | 2016190801 | A1 | 12/2016 |
| WO | 2017163176 | A1 | 9/2017 |

OTHER PUBLICATIONS

International Search Report and Written Opinion of the International Searching Authority mailed in PCT Application No. PCT/IB2020/052637 on Jun. 22, 2020, 09 pages.

Combined Search and Examination Report under Section 17 and 18(3) issued in GB Application No. GB2004124.0 on Sep. 21, 2020, 6 pages.

Examination Report under Section 18(3) issued in GB Application No. GB2004124.0 on Aug. 4, 2021, 4 pages.

Notification Concerning Transmittal of the International Preliminary Report on Patentability issued in PCT Application No. PCT/IB2020/052637 on Sep. 16, 2021, 07 pages.

* cited by examiner

| TYPE | BOARD CONTENT % NANO-CELLULOSE | DENSITY (G/CM³) | THICKNESS SWELL 6 HR 40°C / 85% RH (%) | MODULUS OF ELASTICITY (MPA) | INTERNAL BOND (MPA) | MAX. TENSILE FORCE (N/20 MM) | MOD. OF ELASTICITY IN BENDING (N/MM²) | BENDING STRENGTH (N/MM²) |
|---|---|---|---|---|---|---|---|---|
| FIBRE BOARD | 10% | 0.727 | 1.59 | 3700 | 0.52 | 322.4 | 1922 | 21.9 |
| | 20% | 0.810 | 0.34 | 3950 | 0.59 | 342 | 2238 | 26.4 |
| STANDARD MEDIUM DENSITY FIBREBOARD (MDF) | n/a | 0.780 | 1.34 | 3448 | 0.81 | 331 | 2792 | 27.9 |

FIG. 5

| VOCS | FIBREBOARD | STANDARAD MDF |
|---|---|---|
| FORMALDEHYDE EMISSION (PPM) | 0 | 11 |
| BENZENE MG/M3 | NP | 0.99 |
| TOLUENE MG/M3 | NP | 402 |

FIG. 6

PROCESS AND SYSTEM FOR MANUFACTURING A FIBREBOARD FROM WASTE MATERIALS

TECHNICAL FIELD

The present disclosure relates generally to a process of (for) manufacturing a fibreboard from waste materials, for example corrugated waste materials, and other cellulose-based fibrous waste streams. Moreover, the present disclosure relates to a system that, when in operation, manufactures a fibreboard from waste materials, for example without involving chemical agents. Moreover, the aforesaid process employs micro-fibrillated cellulose (MFC) obtained by processing the waste materials as a natural binding agent for manufacturing the fibreboard.

BACKGROUND

Fibreboard is a type of engineered wood product that is made from wood fibres. Types of fibreboard include particle board or low-density fibreboard, medium-density fibreboard, and hardboard. Medium density fibreboard (MDF) is a reconstituted product generally produced from wood residues. Production quantities of medium density fibreboard (MDF) are recently growing because of its robust performance and its applicability in various professional and household products. As contemporary forest resources are becoming constrained by wood-fibres-based medium-density fibreboard (MDF) production, many attempts have been made to involve waste material as a potential raw material for manufacturing medium density fibreboard (MDF). The amount of household and industrial waste which results from ever growing population and improving standard-of-living has been recently increasing and is such that recycling these wastes is an alternative when seeking to satisfy demand in order to conserve natural resources, as well as to avoid concomitant pollution caused by various methods of waste management including landfilling and incineration that are contemporarily employed. The recycled cellulosic waste stands as a potential source of raw material for the manufacture of environmentally-friendly products and has a potential to make a huge contribution to preserving and expanding global forests that are critical to prevent the long-term loss of carbon to atmosphere, namely a factor that is regarded to be a contributor to anthropogenically-forced climate change.

Existing known approaches for manufacturing the medium density fibreboard (MDF) use root crop residues, straw or wood waste and employ an addition of chemical binders such as glues, resins, or other binding agents in order to produce strong and stable fibreboards; these glues, resins and other binding agents potentially contain toxins. These fibreboards are suitable for manufacturing economically valuable products such as building materials, furniture, construction boards and elements and interior decorative structures. However, the medium density fibreboards (MDF) made with these approaches are very difficult to recycle and do not meet environmental standards as they are susceptible to emit toxic substances which are potentially harmful to human health and also potentially cause damage to the environment when they are subjected to landfills. Recent approaches for manufacturing the medium density fibreboard (MDF) involve using a high-grade micro-fibrillated cellulose (MFC). The high-grade micro-fibrillated cellulose (MFC) is added to improve the fibreboard properties. However, a production cost of micro-fibrillated cellulose (MFC) of a higher grade is very high to involve them in large-scale production of medium density fibreboard (MDF) using waste material sources.

Therefore, in light of the foregoing challenges presented by known art, there exists a need to address, for example to overcome, the aforementioned drawbacks in existing known approaches for manufacturing a fibreboard without the use of high-grade micro-fibrillated cellulose, synthetic glues, resins, or other binding agents, which potentially contain toxins.

In a published Japanese patent application JP2018 059236A ("Production method of cellulose nanofiber compact"; Applicant—Daio Seishi), there is described a process for producing a cellulose nanofiber moulded body, wherein the process comprises a step of dewatering a slurry containing cellulose nanofibers via a mesh-like member, wherein, in the dewatering step, a pressure applied on the slurry is increased stepwise or continuously. Moreover, the dewatering step comprises an initial step of pressurizing the slurry at a pressure of 2.5 kPa or less, and a final step of pressurizing the slurry at a pressure of 20 MPa or more in this order. Furthermore, the content of cellulose nanofibers in the slurry is more than 0.8% by mass.

SUMMARY

The present disclosure seeks to provide an improved process and an improved system that, when in operation, manufactures a fibreboard from a waste material, for example from a corrugated waste material.

According to a first aspect of the present disclosure, there is provided a process of (namely, a process for) manufacturing a fibreboard from a waste material, characterized in that the process comprises:

- a step of pulping at least a portion of the waste material with water to obtain a waste pulp;
- a step of dispersing micro-fibrillated cellulose (MFC) into the waste pulp to obtain a micro-fibrillated waste pulp;
- a step of moulding the micro-fibrillated waste pulp by applying a pressure to obtain a moulded fibreboard, using a moulding process; and
- a step of drying the moulded fibreboard at a temperature to obtain the fibreboard with a density in a range of 500 to 1000 kilograms per cubic metre (kg/m$^3$).

The invention is of advantage in that the fibreboards produced with the process of the present invention are cost-effective, environment-friendly without any toxic chemical additives and are 100 percent recyclable.

Optionally, in the step of drying, the fibreboard is obtained having a density in a range of 650 to 850 kilograms per cubic metre (kg/m$^3$).

Optionally, in the step of drying, the fibreboard is obtained having thickness in a range of 2 mm to 40 mm, and having a board density in a range of 500 kg/m$^3$ to 1100 kg/m$^3$.

Optionally, in the process, the process further comprises filtering the waste material, for example corrugated waste material, to remove contaminants therefrom before pulping the corrugated waste material.

Optionally, in the process, the pressure employed for moulding the micro-fibrillated waste pulp is at least $8\times10^6$ Pascals, for example in a range of $11\times10^6$ Pascals to $12\times10^6$ Pascals.

Optionally, in the process, the temperature for drying the moulded fibreboard is in a range of 110 degrees Celsius to 180 degrees Celsius.

Optionally, in the process, the mechanical micro-fibrillation process comprises steps of:

pulping the waste material to obtain a first solid waste pulp having a solid consistency in a range of 9 percent to 30 percent;

diluting the first solid waste pulp with water to obtain a second solid waste pulp having a solid consistency in a range of 3.5 percent to 6 percent;

providing the second solid waste pulp to a refiner, wherein the refiner comprises a first chamber and a second chamber that are mutually connected through an in-line mixing chamber;

pumping the second solid waste pulp into the first chamber and processing the second solid waste pulp in the in-line mixing chamber before passing the processed second solid waste pulp into the second chamber; and using the refiner to fibrillate the processed second solid waste pulp, and separate the fibres into strands and fibrillar elements to obtain the micro-fibrillated cellulose (MFC).

Optionally, in the process, the micro-fibrillated cellulose is dispersed into the waste pulp in a ratio in a range of 1:3 to 1:20.

Optionally, in the process, the process comprises dispersing the micro-fibrillated cellulose into a pulper for a period in a range of 10 to 20 minutes before adding the corrugated waste material into the pulper for pulping.

Optionally, in the process, the waste material is pulped with the water to ensure complete dispersion for a time period ranging from 5 minutes to 60 minutes in order to obtain the waste pulp.

Optionally, in the process, the process further comprises adding at least one additive along with the micro-fibrillated cellulose while dispersing the micro-fibrillated cellulose into the waste pulp.

Optionally, the at least one additive is a fire retardant; for example, in order to render the moulded fibreboard to be fire retardant, the at least one additive includes ammonium phosphates and ammonium sulphate-/sulfamate-based formulations.

Optionally, when using the process to produce the fibreboard, there is utilized a ratio of micro-fibrillated cellulose to non-modified fibre, namely the waste pulp in a range of 2% to 50%, more optionally in a range of 5% to 30%. These ratios are dependent on the fibre type (for example, fibres from natural sources), dependent upon a degree of MFC conversion that is achievable during refinement in the refiner, and also dependent upon a quality of the fibreboard to be produced, for a strength and density of the fibreboard.

Optionally, in the process, the micro-fibrillated waste pulp is moulded by applying the pressure for a period in a range of 1 to 10 minutes to obtain a moulded fibreboard with a thickness in a range of 6 millimetres (mm) to 25 mm with a tolerance in a range of 0.5 mm to 3.0 mm.

Optionally, in the process, the process further comprises recycling the fibreboard after usage.

Optionally, in the process, the corrugated waste material comprises at least one of: waste cardboards, waste tracing papers, waste papers, recycled papers, textiles, coffee cups or crop residues.

Next, issues associated with refining waste material (for example, derived from recycle paper cardboard, corrugated cellulose waste, alternatively from waste textiles and so forth, as aforementioned), there are optionally employed grinding bars to refine cellulose fibres. Maintaining adequate separation between the bars during refinement is an important technical problem when implementing embodiments of the present disclosure. Beneficially, prolonging an ability to grind cellulose is employed to obtain fibreboard of enhanced strength.

Optionally, a configuration of the refiner that is employed is made dependent on a condition or morphology of fibres present in the waste material that is to be refined to produce the micro-fibrillated cellulose (MFC). When embodiments of the present disclosure are implemented in practice in a manufacturing facility, it is beneficial to employ multiple banks of refining machines arranged in series, for example earlier machines in the series performing coarse grinding of cellulose fibres and later machines in the series providing very fine grinding of the cellulose fibres. Alternatively, the multiple banks of refining machines are arranged in parallel, wherein each machine, when in operation, receives the waste material to be refined and each machine outputs micro-fibrillated cellulose (MFC) that can be mixed with waste pump to provide a mixture to compress and dry to manufacture the fibreboard.

Each refining bank optionally includes refiner bar elements ranging from wide bar elements (to process whole or large fibres) at a start of refinement through to narrow bar elements at an end of refinement (to process small or highly processed fibres or fragments thereof); for example, bar element widths are provided in a range of 20 mm diameter (or greater) to 1 mm diameter (or less). Using bar element widths in an order of 1 mm diameter is unusual and is especially beneficial to employ in embodiments of the present disclosure. In order for the bar elements to have sufficient mechanical strength and resistance to corrosion, it is beneficial that the bar elements are manufactured from Nickel or a Nickel-containing alloy; for example, Nickel-Chromium stainless steel is beneficially used for fabricating the bar elements. More optionally, specialist alloys such a Hastelloy-N, 17-3PH or SS316 Nickel alloy can be employed for the bar elements. Beneficially, the bar elements are cast during their manufacture and ground at their periphery to provide a smooth peripheral surface for use in microfibre refinement. Alternatively, the bar elements are manufactured to have a diameter of 1.5 mm diameter or less and are fabricated from a ceramics material, for example Silicon Carbide material. In the refining machines, the bar elements are straight and disposed in a manner so that their elongate axes are mutually parallel. When the refining machines are in operation, a groove between mutually abutting bar elements has a groove width that is made compatible with a morphology (namely fibre length) of fibres to be ground and refined in the groove. Beneficially, the bar elements are disposed at an angle in a range of 5° to 15° (while maintaining the elongate axes of mutually abutting bar elements to be mutually parallel) to maintain a holdback of fibres in a refining zone of the refining machines during fibre refinement; during later stages of fibre refinement, it is beneficial to employ larger angles greater than 15°, for example in a range of 20° to 30°, for example substantially 25°. By employing such an angular disposition of the bar elements, there is thereby reduced, for example minimized, a cellulose film between the refining bar elements, thereby enabling the refining process to continue more efficiently.

In addition, a disc refiner can be used in the refining equipment. Beneficially, when in operation, such a disc refiner is driven to have a peripheral velocity of 20 metres/second to 25 metres/second. It will be appreciated that using peripheral velocities of less than 20 metres/second increases a potential to retain fibrous material within the refining zone and between the refining bar elements. Employing a reduction in such a peripheral velocity of less than 20 metres/second reduces a mechanical power input required to rotate the disc refiner and the bar elements, thereby reducing energy consumption of the refiner equipment.

It will be appreciated that a consistency or solid content of a fibre/cellulosed mix provided to the refiner is critical to take into account when maintaining a suitable separation of beater bar elements of the refiner during grinding of cellulose fibres to produce the micro-fibrillated cellulose fibres.

Beneficially, between each refining bank of refining machines, the process employs increasing a solid content in an aqueous mix of cellulose fibres that is provided to the refining machines. Optionally, the refining equipment is based on a belt press produced by Alfa Laval Ltd. (United Kingdom).

When refining the fibres in the refiner, an efficiency of dewatering and associated increase in solids content can be enhanced by using polymeric dewatering and/or drainage flocculating agents produced commercially by companies such as Solenis Ltd., United Kingdom; beneficially, a grade PerForm® SP of flocculating agent is employed in the refiner.

When the refiner is in operation, it is beneficial to control a temperature of the waste material mix that is provided to the refiner to improve an efficiency of the refining/grinding process occurring within the refiner, and also to increase fibre viscosity. Increasing fibre viscosity is advantageous because it increases a thickness of the fibre film in the refiner, for example between its bar elements or in its disc refiner. Beneficially, heat exchanges are employed in the refiner between its banks of refining equipment.

According to a second aspect of the present disclosure, there is provided a system that manufactures, when in operation, a fibreboard from a waste material, characterized in that the system comprises:

- a refiner that refines in a range of 5 to 30 percent of the waste material into micro-fibrillated cellulose (MFC) using a mechanical micro-fibrillation process;
- a pulper that pulps in a range of 70 to 95 percent of the waste material with water to obtain a waste pulp, wherein the pulper disperses the micro-fibrillated cellulose into the waste pulp to obtain a micro-fibrillated waste pulp;
- a moulder that moulds the micro-fibrillated waste pulp by applying a pressure to obtain a moulded fibreboard using a moulding process; and
- a dryer that dries the moulded fibreboard to obtain the fibreboard having a density in a range of 500 to 1000 kilograms per cubic metre ($kg/m^3$).

Optionally, in the system, the pressure employed for moulding the micro-fibrillated waste pulp is at least $8\times10^6$ Pascals, for example in a range of $11\times10^6$ Pascals to $12\times10^6$ Pascals, and a temperature for drying the moulded fibreboard is in a range of 110 degrees Celsius to 180 degrees Celsius.

Optionally, in the system, the pulper comprises:

- a first inlet for inputting at least one of the waste materials or a liquid;
- an outlet for outputting the waste pulp; and
- a second inlet for dispersing the micro-fibrillated cellulose into the water pulp, from the refiner.

According to a third aspect of the present disclosure, there is provided a fibreboard comprising micro-fibrillated waste pulp, characterized in that the micro-fibrillated waste pulp is obtained using waste material.

Optionally, the fibreboard comprises at least one of:

- a nano-cellulose content in a range of 10 percent to 20 percent;
- a density in a range of 0.727 to 0.810 gram per cubic centimetre ($g/cm^3$);
- a thickness swell percentage in a range of 1.59 to 0.34 percent at 6 hours, 40 degrees Celsius (° C.) and a relative humidity of 85 percent;
- a modulus of elasticity in a range of 3700 to 3950 megapascals (MPa);
- an internal bond in a range of 0.52 to 0.59 MPa;
- a maximum tensile force in a range of 322.4 to 342 Newton per 20 mm;
- a modulus of elasticity in bending in a range of 1922 to 2238 Newton per square millimetre ($N/mm^2$); and
- a bending strength in a range of 21.9 to 26.4 $N/mm^2$.

Optionally, the micro-fibrillated waste pulp comprises a mixture of micro-fibrillated cellulose (MFC) and waste pulp obtained from the waste material.

Optionally, the fibreboard comprises the waste material in a range of 5 to 30 percent.

Embodiments of the present disclosure substantially eliminate, or at least partially address, the aforementioned drawbacks in existing known approaches for manufacturing a fibreboard without the use of high-grade micro-fibrillated cellulose, synthetic glues, resins, toxins or other binding agents.

Additional aspects, advantages, features and objects of the present disclosure are made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein:

FIG. 5 is a table that provides a comparison of physical properties of a fibreboard that is manufactured using a process according to an embodiment of the present disclosure and a standard medium-density fibreboard; and FIG. 6 is a table that provides a comparison of toxic emission by volatile organic compounds while recycling the fibreboard that is manufactured using a process according to an embodiment of the present disclosure and a standard medium-density fibreboard.

DETAILED DESCRIPTION OF EMBODIMENTS

Figure 1:
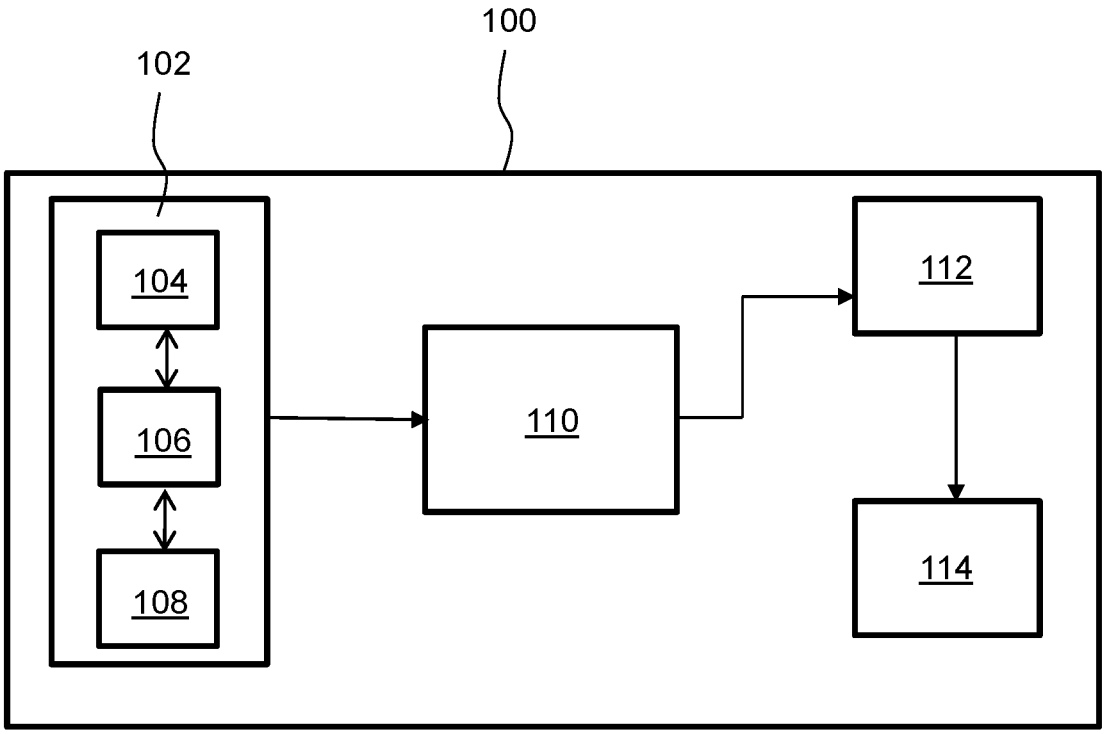
FIG. 1 is a schematic illustration of a system according to an embodiment of the present disclosure.

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

In overview, manufacturing MFC (Micro Fibrillated Cellulose) involves reducing cellulose-based material, namely traditionally wood, from whole fibres to "fragments or microparticles". Conventionally, in embodiments of the present disclosure, particle size reduction methods are employed that can be implemented using equipment that is commonly used in the paper industry; the equipment includes, for example, fibre refiners/beaters where the fibres pass between bar elements of which at least one bar element is rotating when in operation. An axial load is applied to the bar elements which then creates a refining or grinding effect. However, it will be appreciated that significant quantities of energy are consumed as particle size is reduced to provide the refining or grinding effect. Energy consumption increases as fibre fragment size reduces to achieve a given reduction in particle size.

One major issue with these particle size reduction methods is that the fibres must have a required strength and/or integrity to keep the bars apart during grinding. However, as grinding progresses, the fibres lose an ability to uphold the separation of the bars, resulting in potential mutual contact of the bars occurring, resulting in both mechanical damage to the bars and substandard fibre grinding. Thus, these particle size reduction methods are limited in their reliability process by the integrity of the fibres.

According to an aspect of the present disclosure, there is provided a process of (namely, a process for) manufacturing a fibreboard from a waste material, for example from corrugated waste material, for example optionally from a single stream of waste material, wherein the process comprises:

- refining a portion, for example in a range of 5 to 30 percent, of the waste material into micro-fibrillated cellulose (MFC), using a mechanical micro-fibrillation process;
- pulping a portion, for example in a range of 70 to 95 percent, of the corrugated waste material with water to obtain a waste pulp;
- dispersing, the micro-fibrillated cellulose (MFC) into the waste pulp to obtain a micro-fibrillated waste pulp;
- moulding the micro-fibrillated waste pulp by applying a pressure to obtain a moulded fibreboard, using a moulding process; and
- drying the moulded fibreboard at a given temperature to obtain the fibreboard with a density in a range of 500 to 1000 kilograms per cubic metre ($kg/m^3$), for example in a range 650 to 850 kilograms per cubic metre ($kg/m^3$).

The present process is of advantage in that it helps to manufacture fibreboard from the waste material, for example corrugated waste material, or other cellulose based fibrous waste streams as a source of raw material. Other fibrous waste streams are also envisaged, including non-cellulose fibres, chemically modified cellulose fibres, synthetic fibres, and man-made fibres. The fibreboard that is manufactured using the present process meets environmental standards and prevents toxic emissions as it does not use any chemical additives that potentially cause harmful to personnel involved with manufacturing it or to the biosphere in general. The present process thus uses the micro-fibrillated cellulose (MFC) derived from the waste material (e.g. cardboards, packaging materials, textiles etc.) for manufacturing the fibreboard and does not require any newly mined or harvested raw materials such as cellulose fibres which are potentially harvested from trees or plants. The present process involves the use of low-grade micro-fibrillated cellulose (MFC) which is obtained by refining the waste material as a natural binding agent for manufacturing the fibreboard, thereby avoiding chemical binding agents.

The waste material used for manufacturing micro-fibrillated cellulose (MFC) for use in manufacturing fibreboard pursuant to the present disclosure is capable of being sourced from diverse sources, for example chosen from one or more of:

(i) natural wood, for example wood residues (for example from sawmills, such as wood off-cuts, sawdust and such like);
(ii) natural residues, for example cellulosic biomass of various types;
(iii) manmade wood-based construction boards (for example from recycled MDF, particle boards, chip board and such like);
(iv) waste and by-products from papermaking fibre, virgin, pre-consumer waste and/or post-consumer waste (PCW waste);
(v) waste of various grades such as newsprint, mixed office waste;
(vi) recovered fibre such as municipal cellulose waste (for example derived from black bag domestic fibre;
(vii) annual (seasonal) fibre (for example, at least one of: jute, hemp, flax, cotton, abaca, kenaf, bagasse, manila);
(viii) crop residues (for example, cereal wheat straw, sugar beet husk, maize stover, pea pod residue, grape pomace);
(ix) synthetic cellulose (for example, produced by genetically modified microorganisms); and
(x) textile waste.

Textile waste in (x) can be in three potential categories: natural fibres, synthetic fibres, blended fibres including a mixture of natural fibres and synthetic fibres. Natural fibres can include, for example, cotton, wool, linen. Synthetic fibres can include polyester, polyamine (for example, Nylon®), acetate fibres. Mixed fibres can include a polyester-cotton blend or a polyester-wool blend.

For the fibreboard pursuant to the present disclosure to be environmentally friendly, it is important to avoid microplastics particles in the biosphere. Whereas natural fibres such as cotton and wool are completely biocompatible because these materials are easily broken down by microbes in the biosphere, synthetic fibres have to be treated to make them biocompatible to the biosphere by employing as processes as will next be described.

A first process that is optionally employed to separate out synthetic manmade fibres includes steps of:

(i) mechanically separating out fibres from a given woven substrate (such as waste textiles) by using apparatus such as a hammer mill; and (ii) using air classification of the separated fibres from step (i) according to density and size in order mutually to segregate synthetic and fibres for use in MFC fibreboard production.

Optionally, one or more enzymes are used selectively to separate or dissolve natural or synthetic fibres. In a granted European patent EP2922906B1 ("Method of recycling plastic products"; Applicant—Carbios), use of a cutinase for depolymerization purposes is disclosed. Such cutinase is also beneficially used in embodiments of the present disclosure to separate out synthetic manmade fibres in the given woven substrate to make the fibres thereby obtained suitable for manufacturing fibreboard pursuant to the present disclosure that is biocompatible with the biosphere. Moreover, Use of acid hydrolysis to chemically dissolve synthetic fibres in mixed textiles to release natural fibres is also beneficial to employ; for example, in a published United States patent application US2018/01230286A1 ("Polymer recycling"; Applicant—Georgia State University Research Foundation Inc.), there is described a process of making a culture medium from a polymeric material by using a combination of an organic acid, an inorganic acid having a boiling point of less than 150° C., a base, an oil, a non-polar organic solvent, or a combination thereof to process a wide range of polymeric materials into more biologically benign compounds for the biosphere; the process is beneficially employed in embodiments of the present disclosure to separate out natural fibres from synthetic fibres, so that fibreboard manufactured therefrom are biocompatible with the biosphere. Such selective used of enzymes and chemicals enables textile waste of mixed synthetic fibre and natural fibres to be employed to provided micro-fibrillated fibres for use in fibreboard manufacture pursuant to the present disclosure.

In an embodiment, the present process of manufacturing the fibreboard from the waste material, for example corrugated waste material, is a continuous process. In another embodiment, the micro-fibrillated waste pulp is moulded by applying a pressure to obtain the moulded fibreboard using a continuous mesh process. The micro-fibrillated waste pulp is optionally further refined to form a surface laminate for the fibreboard, thereby removing a need for customers to glue environmentally unfriendly high-pressure laminates, melamine laminates or veneers to the surface of the fibreboard.

In an embodiment, the micro-fibrillated cellulose is uniformly dispersed into the waste pulp to obtain the micro-fibrillated waste pulp using a uniform and controlled process. By "uniformly" is meant having a uniformity variation of less then +/−10%, and optionally having a uniformity variation of less than +/−3% in dispersion. The micro-fibrillated cellulose is dispersed into the waste pulp for at least 20 minutes to obtain uniformly dispersed micro-fibrillated waste pulp.

The micro-fibrillated cellulose (MFC) derived from the waste material, for example corrugated waste material, is susceptible to being combined with untreated waste cellulose from the same waste material to manufacture a thick and strong fibreboard; by "strong", for example, is mechanical properties that are substantially similar to solid wood, for example pine wood. The fibreboard is optionally recycled after usage for remanufacturing it again with the same quality for many times. For example, a cupboard is optionally made with all surfaces, handles, hinges and exterior finish made from the waste material, thereby avoiding a need to utilize materials such as metals, plastics materials, wooden dowels or laminate finishes.

The fibreboard that is manufactured using the present process is potentially usable for manufacturing economically-valuable products such as building materials, furniture, construction boards/elements and interior decorative structures. The fibreboard is also optionally used for manufacturing at least one of (for example, all of): partition walls, doors, flooring surfaces, kitchen work surfaces, cabinets, exhibition stands, retail interiors, signage boards, recycling bins, ceiling tiles and acoustic panels.

The present process optionally employs a three-dimensional (3D) moulding process for manufacturing three-dimensional (3D) fibreboard products such as hinges and brackets, pots, trays and cups, flower pots that are biodegradable, seat shells and chairbacks or architraves.

According to another embodiment, the process further comprises filtering the corrugated waste material to remove contaminants therefrom before pulping the corrugated waste material. The filtering of contaminants from the corrugated mixed waste optionally includes removing non-cellulosic waste materials such as glass or metal and separating the cellulosic corrugated waste material for further processing.

According to yet another embodiment, the pressure employed for moulding the micro-fibrillated waste pulp is at least $8\times10^6$ Pascals, for example in a range of $11\times10^6$ Pascals to $12\times10^6$ Pascals. The micro-fibrillated waste pulp is optionally pressed in the mould and then transferred onto a belt for further pressing by applying a pressure in a range of $12\times10^6$ Pascals to $14\times10^6$ Pascals.

In an embodiment, the moulding process in a batch process. The micro-fibrillated waste pulp is charged into a large press with flat platens and pressed by applying a pressure of at least $8\times10^6$ Pascals, for example in a range of $12\times10^6$ Pascals to $14\times10^6$ Pascals.

In another embodiment, the moulding process is a continuous process. The continuous moulding process yields fibreboards of indefinite length. In an embodiment, the micro-fibrillated waste pulp is charged into a headbox. The headbox keeps the micro-fibrillated waste pulp from clumping together and to uniformly disperse the micro-fibrillated waste pulp into dynamic forming platens with continuously revolving rolls which apply pressure in a range of $12\times10^6$ Pascals to $14\times10^6$ Pascals.

According to yet another embodiment, the temperature for drying the moulded fibreboard is in a range of 110 degrees Celsius to 180 degrees Celsius. The moulded fibreboard is optionally dried using a multi-stage drying process, for example a six-stage drying process, using temperature variations to enable the fibres to be bonded evenly throughout the fibreboard. The six-stage process involves different zones which are held at different temperatures. The air flow into each zone can be varied to influence the heating and temperature of the fibreboard for moisture removal.

In an example embodiment, the moulded fibreboard is optionally dried using a process that combines a conventional convection drying with at least one of:

(i) an infra-red (IR) drying of the moulded fibreboard, wherein the drying is implemented in a plurality of stages;

(ii) a vacuum-assisted drying of the moulded fibreboard;

(iii) microwave heating drying of the moulded fibreboard, (iv) a hot-air jet drying of the moulded fibreboard, or any combination of (i) to (iv). Optionally, various forms of drying from (i) to (iv) are employed in temporal sequence, for example commencing with (i) and ending with (ii), wherein (ii) synergistically enables the fibreboard to be subject to vacuum impregnation of materials (for example, varnish) that close surface pores of the moulded fibreboard to render it suitable for long-time exposure to outdoor environments.

The IR drying provides IR radiation energy which is transferred to the fibreboard without heating the surrounding air. IR radiation penetrates the fibreboard and heats the fibreboard internally. The convection drying removes the moisture at the surface of the fibreboard. In an embodiment, pocket ventilation process is used to remove the moisture at the surface of the fibreboard by providing forced air flow.

According to yet another embodiment, the mechanical micro-fibrillation process comprises steps of:

- pulping the corrugated waste material to obtain a first solid waste pulp having a solid consistency in a range of 9 percent to 30 percent;
- diluting the first solid waste pulp with water to obtain a second solid waste pulp having a solid consistency in a range of 3.5 percent to 6 percent;
- providing the second solid waste pulp to a refiner, wherein the refiner comprises a first chamber and a second chamber that are mutually connected through an in-line mixing chamber;
- pumping the second solid waste pulp into the first chamber and processing the second solid waste pulp in the in-line mixing chamber before passing the processed second solid waste pulp into the second chamber; and
- using the refiner to fibrillate the processed second solid waste pulp, and separate the fibres into strands and fibrillar elements to obtain the micro-fibrillated cellulose (MFC).

In an embodiment, the refiner is a conical refiner or a disc refiner. The refiner potentially transfers its energy to the fibres to obtain the micro-fibrillated cellulose. Alternatively, the refiner is implemented using bars or microbars as described in the foregoing.

During refinement to generate the micro-fibrillated cellulose to use as a binder in the fibreboard, the use of appropriate enzymes (for example one or more of: Xylanase, hemicellulases, Cellulase) to break down hemicellulose chemically is beneficially employed; a use of such enzymes renders the fibres "fragile", enabling refining of the fibres to be more energy efficient.

An example of such enzymes is a Cellulase produced by Novozymes A/S of Denmark, for example a grade of enzymes known commercially by a trade name FiberCare®. Addition rates of such enzymes to the fibre during refinement is beneficially adjusted subject to both fibre and enzyme type. In addition, an effectiveness of such refinement of fibres is governed by parameters such as fibre contact time, a chemical environment such as pH and refinement temperature; beneficially, such parameters such as pH and temperature are monitored and controlled using feedback loops in apparatus using control units in order to achieve a consistent and reliable refinement process. The use of enzymes is capable of reducing energy used in refining the fibres when generating the micro-fibrillated cellulose fibres in comparison to employing merely a purely mechanical refinement process.

According to yet another embodiment, the micro-fibrillated cellulose is dispersed into the waste pulp in a ratio in a range of 1:3 to 1:20.

According to yet another embodiment, the process comprises dispersing the micro-fibrillated cellulose into a pulper for a period in a range of 10 to 20 minutes before adding the corrugated waste material into the pulper for pulping.

According to yet another embodiment, the corrugated waste material is pulped with the water to ensure complete dispersion for a time period ranging from 5 minutes to 60 minutes in order to obtain the waste pulp.

According to yet another embodiment, the process further comprises adding at least one additive along with the micro-fibrillated cellulose while dispersing the micro-fibrillated cellulose into the waste pulp.

Optionally, the at least one additive is a fire retardant; for example, in order to render the fibreboard to be fire retardant, the at least one additive includes ammonium phosphates and ammonium sulphate-/sulfamate-based formulations.

According to yet another embodiment, the micro-fibrillated waste pulp is moulded by applying the pressure for a period in a range of 1 to 10 minutes to obtain a moulded fibreboard with a thickness in a range of 6 millimetres (mm) to 25 mm with a tolerance in a range of 0.5 mm to 3.0 mm.

According to yet another embodiment, the process further comprises recycling the fibreboard after usage.

According to yet another embodiment, the corrugated waste material comprises at least one of (for example, all of): waste cardboards, waste tracing papers, waste papers, recycled papers, textiles, coffee cups, tea cups and crop residues.

According to a second aspect, the present disclosure relates to a system that, when in operation, manufactures a fibreboard from a corrugated waste material, comprising:

- a refiner that refines in a range of 5 to 30 percent of the corrugated waste material into micro-fibrillated cellulose (MFC) using a mechanical micro-fibrillation process;
- a pulper that pulps in a range of 70 to 95 percent of the corrugated waste material with water to obtain a waste pulp;
- a moulder that moulds the micro-fibrillated waste pulp by applying a pressure to obtain a moulded fibreboard using a moulding process; and
- a dryer that dries the moulded fibreboard to obtain the fibreboard with a density in a range of 650 to 850 kilograms per cubic metre ($kg/m^3$).

The advantages of the present system are thus identical to those disclosed above in connection with the present process and the embodiments listed above in connection with the present process apply mutatis mutandis to the present system.

In an embodiment, the corrugated waste material is shredded into small pieces to facilitate pulping. For example, the small pieces have a size in a range of 0.1 to 5.0 square metre. The refiner optionally comprises an inlet for providing the water for pulping.

In an embodiment, the refiner repeatedly pumps the second solid waste pulp from a first chamber to a second chamber through an in-line mixing chamber to obtain micro-fibrillated cellulose (MFC) with a quality that enables to bind cellulose fibres while manufacturing the fibreboard. The moulded micro-fibrillated waste pulp is optionally dried to form the fibreboard using heat sources. The heat sources optionally include infra-red energy sources or microwave energy sources.

In an embodiment, the system comprises a deflaker. The pulped corrugated waste material is charged into the deflaker. The deflaker includes rotary elements that create a field of hydraulic shear. This hydraulic shear helps to reduce the flake content of the corrugated waste material after pulping.

In an embodiment, the corrugated waste material is pulped to obtain a first solid waste pulp having a solid consistency in a range of 9 to 15 percent.

According to an embodiment, the pressure employed for moulding the micro-fibrillated waste pulp is in a range of $11\times10^6$ Pascals to $12\times10^6$ Pascals, and a temperature for drying the moulded fibreboard is in a range of 110 degrees Celsius to 180 degrees Celsius.

In an embodiment, a time period for applying the pressure for moulding the micro-fibrillated waste pulp and the temperature for drying the moulded fibreboard are selected, namely optimized, to obtain complete dryness throughout the fibreboard.

According to another embodiment, the pulper comprises:

a first inlet for inputting at least one of the corrugated waste materials or a liquid;

an outlet for outputting the waste pulp; and a second inlet for dispersing the micro-fibrillated cellulose into the water pulp, from the refiner.

In an embodiment, the corrugated waste material is filtered to remove non-cellulosic materials before pulping. In an embodiment, the system comprises a screening basket that filters the corrugated waste material before pulping. In an embodiment, the pulper is charged approximately to a capacity of 0.350 ton or 9 metre cubes ($m^3$). The pulper is optionally charged to a height of approximately 60 percent of the pulper. In an embodiment, the corrugated waste material pulp has a solid consistency in a range of 4.0 percent to 4.5 percent. In an embodiment, a percentage of the micro-fibrillated cellulose (MFC) that is dispersed into the pulper to obtain the micro fibrillated waste pulp depends on the solid consistency of the corrugated mixed waste pulp. In another embodiment, the refiner processes the corrugated waste material to obtain the micro-fibrillated cellulose (MFC) having a solid consistency of 30 percent. In an embodiment, the refiner refines the corrugated waste material to obtain a second solid waste pulp having a solid consistency of 3.5 percent.

In an embodiment, the second solid waste pulp having the solid consistency of 3.5 percent is repeatedly pumped into the first chamber through the in-line mixing chamber from the second chamber to adjust the solid consistency of the second solid waste pulp. The solid consistency of the second solid waste pulp is optionally adjusted based on a viscosity that is developed during the dispersion of the second solid waste pulp into the pulper.

In an embodiment, the system comprises a mixer that is installed at a discharge outlet of the first chamber of the refiner.

In an embodiment, the micro-fibrillated cellulose (MFC) samples are taken from the refiner for a nib and strength testing.

In an embodiment, the first chamber and the second chamber are filled to a capacity of 80 $m^3$ with the second solid waste pulp having a solid consistency of 3.5% to obtain 2.8 tons dry pulped corrugated waste material. In an embodiment, a minimum of 54.0 tons dry pulped corrugated waste material and a minimum of 7.7 tons dry micro-fibrillated cellulose is required for continuous production of the fibreboard for 72 hours at 9 moulds per hour.

In an embodiment, during pulping, 12.5 percent of the micro-fibrillated cellulose (MFC) is dispersed into 87.5% of the corrugated waste material to obtain the micro-fibrillated waste pulp.

In an embodiment, the system employs a K9 grade production condition for manufacturing the fibreboard. In an embodiment, the K9 grade production condition is an international standard on quality management and quality assurance to maintain an efficient quality system for manufacturing the fibreboard.

In an embodiment, the system includes production parameters for manufacturing the fibreboard. The production parameters include a deckle size of 3.8 metre, a board thickness of 15 mm, a board density of 700 kilograms per cubic metre ($kg/m^3$), a mass flow of 39.9 kilograms per metre (Kg/m), a paper machine line speed of 5.64 metre per minute (m/min) to achieve a production rate of 13.51 tons per hour (t/hr) with an annual production rate of 10.0 metric metre per annum.

In an embodiment, the moulded fibreboard with a thickness of 14 mm and a tolerance +/−2 mm is obtained with the system employing a stop time of 260 seconds and a dwell time of 100 seconds.

In an embodiment, the system has a production rate of minimum 9 fibreboards per hour. In an embodiment, a machine speed of a dryer includes 1.0 metre per minute. In an embodiment, the fibreboard is monitored, while on-machine, both on a surface of the fibreboard and in a z-direction (orthogonal to a plane of the surface of the fibreboard).

In an embodiment, the system includes a recording unit for measuring at least one of the following processing conditions such as pulper amperage drawn, chemical flows/additions, a height of a head tank, a mould drainage time/a dwell time, a mould vacuum pressure, a pressing time/a pressure, vacuum pump amplifiers, a board calliper, a machine speed or a dryer operating temperatures/air flow for manufacturing the fibreboard.

In an embodiment, after drying, the fibreboard is sanded in a range of 6 mm to 9 mm to obtain sanded fibreboard. In another embodiment, the fibreboard is laminated in a range of 18 mm to 22 mm to obtain laminated fibreboard.

According to a third aspect of the present disclosure, there is provided a fibreboard comprising micro-fibrillated waste pulp, characterized in that the micro-fibrillated waste pulp is obtained using waste material.

Optionally, the fibreboard comprises at least one of:

- a nano-cellulose content in a range of 10 percent to 20 percent;
- a density in a range of 0.727 to 0.810 gram per cubic centimetre ($g/cm^3$);
- a thickness swell percentage in a range of 1.59 to 0.34 percent at 6 hours, 40 degrees Celsius (° C.) and a relative humidity of 85 percent;
- a modulus of elasticity in a range of 3700 to 3950 megapascals (MPa);
- an internal bond in a range of 0.52 to 0.59 MPa;
- a maximum tensile force in a range of 322.4 to 342 Newton per 20 mm;
- a modulus of elasticity in bending in a range of 1922 to 2238 Newton per square millimetre ($N/mm^2$); and
- a bending strength in a range of 21.9 to 26.4 $N/mm^2$.

Optionally, the micro-fibrillated waste pulp comprises a mixture of micro-fibrillated cellulose (MFC) and waste pulp obtained from the waste material.

Optionally, the fibreboard comprises the waste material in a range of 5 to 30 percent.

Embodiments of the present disclosure are capable of manufacturing the fibreboard from the waste material, for example corrugated waste material, as a source of raw material. Embodiments of the present disclosure are capable of manufacturing fibreboard that meets environmental standards and prevents toxic emissions when the fibreboard is recycled after usage. Embodiments of the present disclosure use the micro-fibrillated cellulose (MFC) derived from the corrugated waste material (e.g. cardboards, packaging materials, textiles etc.) for manufacturing the fibreboard and does not require any newly mined or harvested raw materials such as cellulose fibres which are potentially harvested from trees or plants. Embodiments of the present disclosure optionally use low-grade micro-fibrillated cellulose (MFC) which is obtained by refining the corrugated waste material as a natural binding agent for manufacturing the fibreboard, thereby avoiding a need to employ chemical binding agents. Embodiments of the present disclosure are capable of manufacturing the cost-effective fibreboard with the corrugated waste materials.

DETAILED DESCRIPTION OF THE DRAWINGS

FIG. 1 is a schematic illustration of a system 100 according to an embodiment of the present disclosure. The system 100 comprises a refiner 102, a pulper 110, a moulder 112 and a dryer 114. The refiner 102 includes a first chamber 104, an in-line mixing chamber 106 and a second chamber 108. The function of these parts has been described above.

Figure 2:
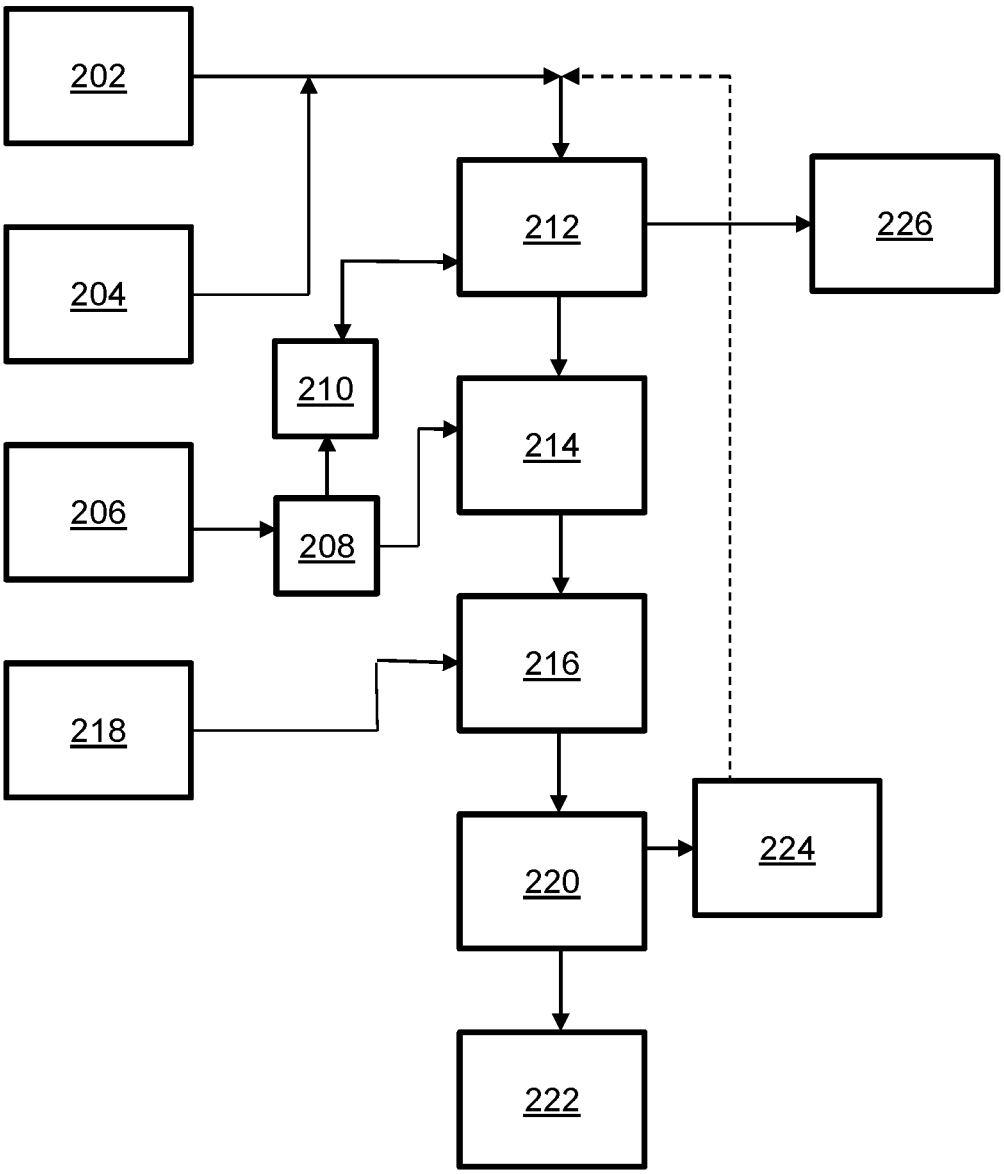
FIG. 2 is a flowchart illustrating steps of a process for (namely, a process of) manufacturing a fibreboard from a waste material, for example from a corrugated waste material, according to an embodiment of the present disclosure.

FIG. 2 is a flowchart illustrating steps of a process for (of) manufacturing a fibreboard from a corrugated waste material according to an embodiment of the present disclosure, for example using the aforesaid system 100. At a step 202, the corrugated waste material is provided to a refiner and a pulper. At a step 204, the refiner refines micro-fibrillated cellulose (MFC) using a mechanical micro-fibrillation process and provides the refined MFC along with additives to the pulper. At a step 206, water is provided through a first inlet. At a step 208, a first water loop receives the water from the first inlet. At a step 210, a second water loop receives the water from first water loop and provides the water to the pulper. At a step 212, the pulper pulps the corrugated waste material with water to obtain a waste pulp and disperses the micro-fibrillated cellulose into the waste pulp to obtain a micro-fibrillated waste pulp. At a step 214, a moulder moulds the micro fibrillated waste pulp by applying a pressure to obtain a moulded fibreboard and optionally receives water from the first water loop. At a step 216, a dryer dries the moulded micro-fibrillated waste pulp to obtain a fibreboard. At a step 218, steam or power is provided to the dryer for drying the moulded micro-fibrillated waste pulp. At a step 220, the fibreboard is finished or profiled to obtain a finished fibreboard. At a step 222, the finished fibreboard is stored in a warehouse. At a step 224, the fibreboard that is rejected is recycled by providing it into the pulper again at the step 212. At a step 226, the rejected materials from the step 212 are recycled.

Figure 3:
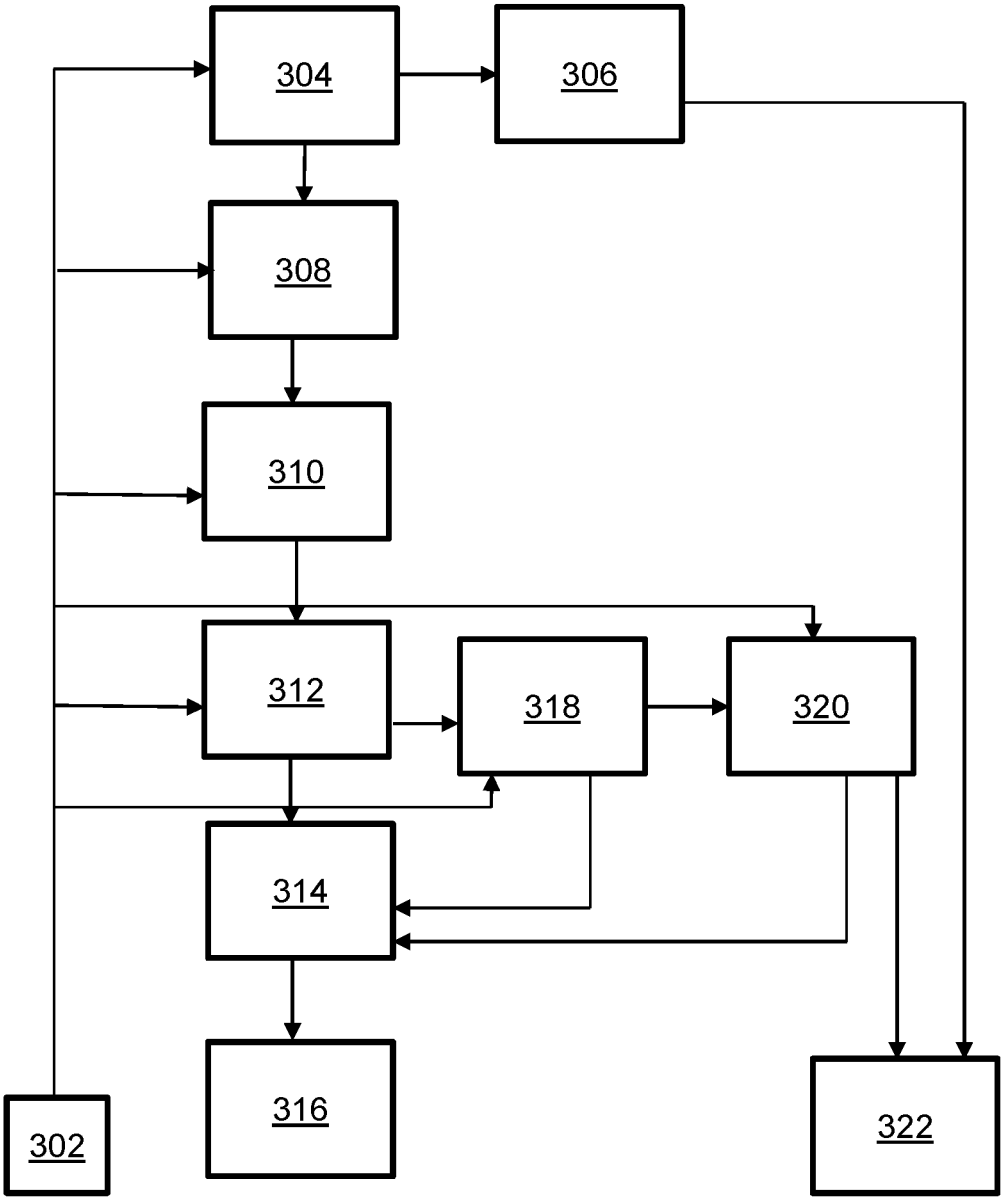
FIG. 3 is a flowchart illustrating steps of a process for (namely, a process of) recycling a fibreboard according to an embodiment of the present disclosure.

FIG. 3 is a flowchart illustrating steps of a process for (of) recycling a fibreboard according to an embodiment of the present disclosure. At a step 302, water is provided to a pulper. At a step 304, a fibreboard to be recycled is provided to a pulper and the pulper pulps the fibreboard with water to obtain water pulp. The fibreboard is manufactured using a process according to an embodiment of the present disclosure. At a step 306, the water pulp is screened to remove contaminants. At a step 308, the water pulp is provided to a buffer tank and the buffer tank optionally receives water. A a step 310, the water pulp is provided into a high-density cleaner for cleaning and the high-density cleaner optionally receives water for cleaning the water pulp. At a step 312, a primary screening of the water pulp is performed to remove contaminants. At a step 314, the primary cleaned water pulp is introduced into a feed system. At a step 316, the primary screened water pulp is provided to a system for manufacturing fibreboard. At a step 318, a secondary screening of the water pulp is performed if the primary screened water pulp does not meet a manufacturing quality and the secondary screened water pulp is optionally introduced into the feed system. At a step 320, a tertiary screening of the water pulp is performed if the secondary screened water pulp does not meet the manufacturing quality and the secondary screened fibreboard pulp is optionally introduced into the feed system. At a step 322, the water pulp that does not meet the manufacturing quality after the tertiary screening are rejected.

Figure 4A:
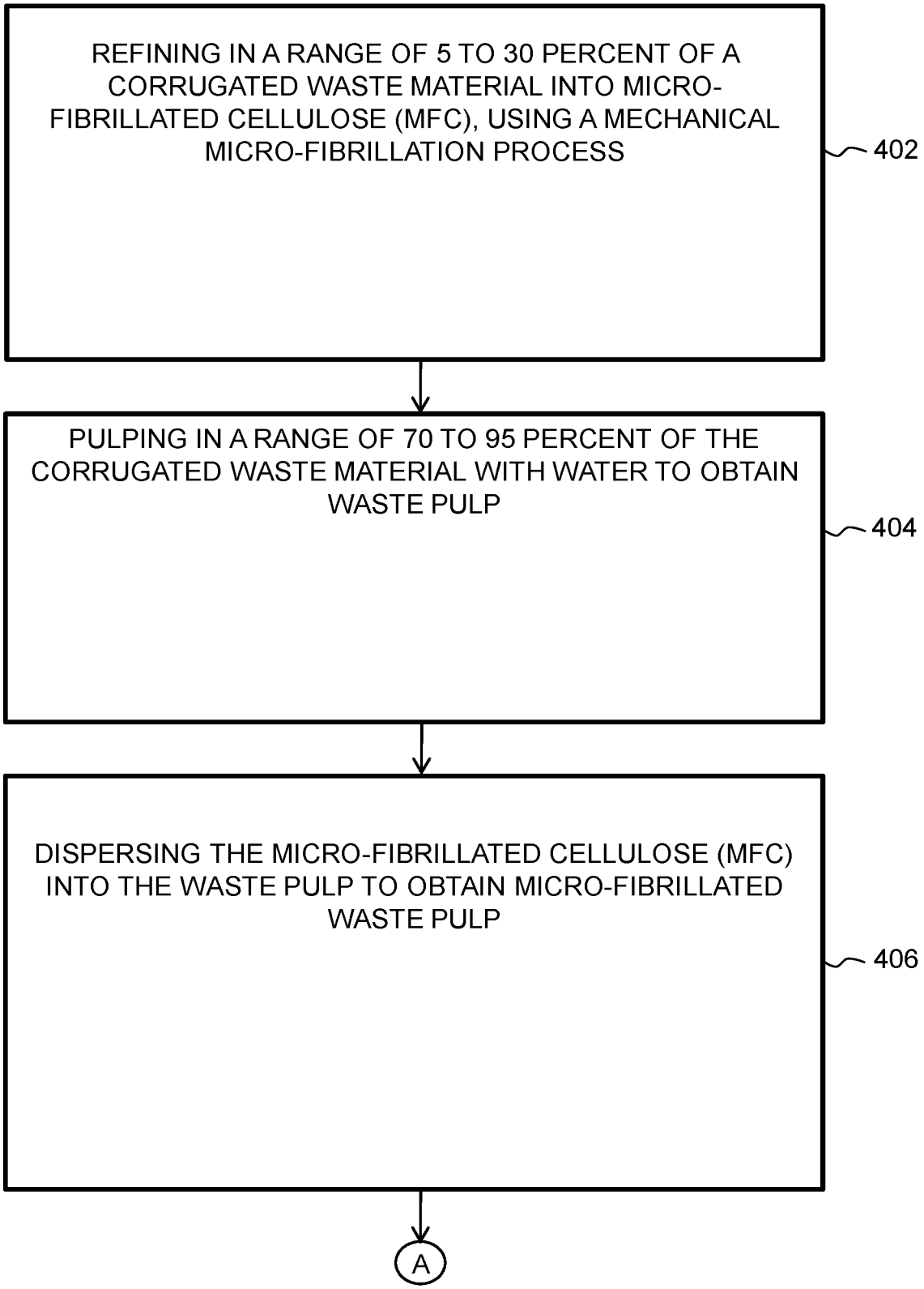
FIGS. 4A and 4B are flow diagrams that illustrate steps of a process for (namely, a process of) manufacturing a fibreboard from a waste material, for example from a corrugated waste material, according to an embodiment of the present disclosure.
Figure 4B:
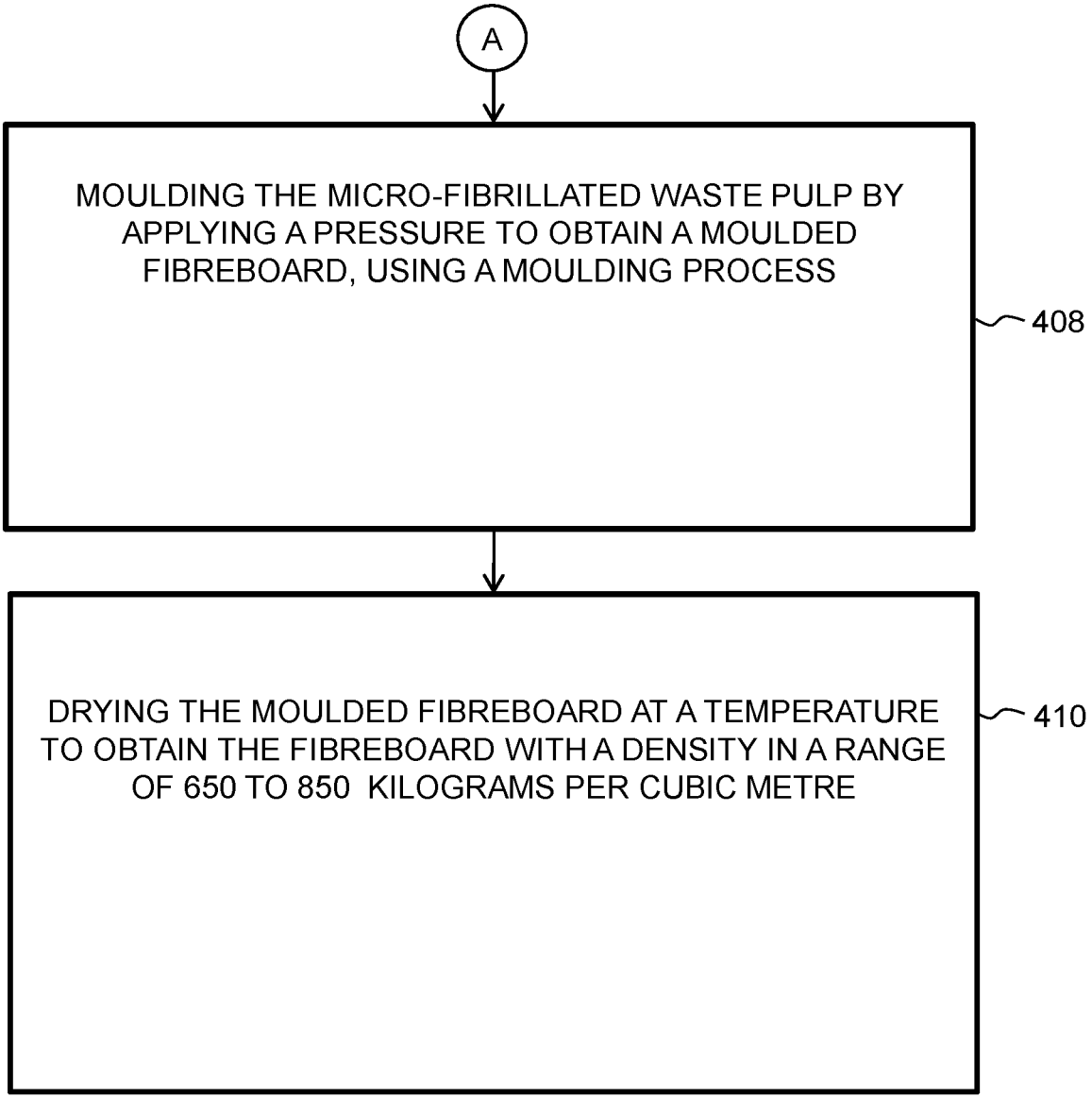

FIGS. 4A and 4B are flow diagrams that illustrate steps of a process for (of) manufacturing a fibreboard from a corrugated waste material according to an embodiment of the present disclosure. At a step 402, a range of 5 to 30 percent of the corrugated waste material is refined into micro-fibrillated cellulose (MFC), using a mechanical micro-fibrillation process. At a step 404, a range of 70 to 95 percent of the corrugated waste material is pulped with water to obtain a waste pulp. At a step 406, the micro-fibrillated cellulose (MFC) is dispersed into the waste pulp to obtain a micro-fibrillated waste pulp. At a step 408, the micro-fibrillated waste pulp is moulded by applying a pressure to obtain a moulded fibreboard, using a moulding process. At a step 410, the moulded fibreboard is dried at a temperature to obtain the fibreboard with a density in a range of 650 to 850 kilograms per cubic metre ($kg/m^3$).

FIG. 5 is a table that illustrates a comparison of physical properties of a fibreboard that is manufactured using a process according to an embodiment of the present disclosure and a standard medium-density fibreboard (MDF). The fibreboard manufactured by the process according to an embodiment herein includes a nano-cellulose content in a range of 10 percent to 20 percent, a density in a range of 0.727 to 0.810 gram per cubic centimetre ($g/cm^3$), a thickness swell percentage in a range of 1.59 to 0.34 percent at 6 hours, 40 degrees Celsius (° C.) and a relative humidity of 85 percent, a modulus of elasticity in a range of 3700 to 3950 megapascals (MPa), an internal bond in a range of 0.52 to 0.59 MPa, a maximum tensile force in a range of 322.4 to 342 Newton per 20 mm, a modulus of elasticity in bending in a range of 1922 to 2238 Newton per square millimetre ($N/mm^2$) and a bending strength in a range of 21.9 to 26.4 $N/mm^2$. The standard MDF includes a density of 0.780 $g/cm^3$, a thickness swell percentage of 1.34 percent at 6 hours, 40 degrees Celsius (° C.) and a relative humidity of 85 percent, a modulus of elasticity of 3448 MPa, an internal bond of 0.81 MPa, a maximum tensile force of 331 N/20 mm, a modulus of elasticity in bending 2792 $N/mm^2$ and a bending strength of 27.9 $N/mm^2$. The modulus of elasticity of the fibreboard manufactured by the process according to an embodiment herein is greater than the modulus of elasticity of the standard MDF. The values of physical parameters including the density, the internal bond, the maximum tensile force, the modulus of elasticity in bending and the bending strength of the fibreboard manufactured by the process according to an embodiment herein, are similar to the values of standard MDF without an addition of chemical/synthetic processing agent which are involved in the manufacturing of the standard MDF.

FIG. 6 is a table that illustrates a comparison of toxic emission by volatile organic compounds (VOCS) while recycling the fibreboard that is manufactured using a process according to an embodiment of the present disclosure and a standard medium density fibreboard (MDF). The table indicates that the fibreboard manufactured by the process according to an embodiment herein does not emit any volatile organic compounds (VOCs) while recycling. Whereas, the standard MDF emits the volatile organic compounds (VOCs) such as a formaldehyde of 11 ppm, a benzene of 0.99 milligram per cubic metre ($mg/m^3$) and a toluene of 402 $mg/m^3$ while recycling.

The fibreboard manufactured pursuant to the present disclosure has characteristics that make it suitable for precision joinery applications, because the fibreboard is resistant to flaking or splitting. Such physical characteristics make the fibreboard pursuant to the present disclosure suitable for manufacturing furniture, for example:

(a) kitchen furniture having a kitchen carcass employing fibreboard pursuant to the present disclosure having a conventional thickness in a range of 9.5 mm to 19.1 mm;

(b) backs for the kitchen carcass of (a), wherein the backs employ fibreboard pursuant to the present disclosure having a conventional thickness in a range of 3.2 to 6.35 mm; and (c) kitchen worktops, for example for the kitchen carcass of (a), wherein the worktops employ fibreboard pursuant to the present disclosure having a conventional thickness in a range of 22 to 40 mm, for example achieved through lamination of plies fabricated from fibreboard pursuant to the present disclosure.

Beneficially, fibreboard pursuant to the present disclosure can be manufactured to various densities and qualities, depending upon use requirements. For example, using additives such as acetyl anhydride during its manufacture makes the fibreboard relatively harder and less likely to suffer mould and fungal attacks. Moreover, using greater pressures during the step of moulding the fibreboard render the fibreboard denser and hence more resistant to ingress of moisture.

Optionally, enzymic hydrophobic additives can be included in the step of dispersing the micro-fibrillated cellulose (MFC) into the waste pulp to obtain a micro-fibrillated waste pulp to enable the fibreboard to resist moisture. Such manufacturing features enable the fibreboard to be used in outside environments where precipitation can be encountered in practice.

The fibreboard pursuant to the present disclosure is also susceptible to being used to manufacture other items of furniture, for example:

(i) door skins;

(ii) furniture items, for example tables, chairs, structural forms for sofas.

Moreover, the fibreboard pursuant to the present disclosure can be beneficially employed for construction boards, advertising boards and similar, for example:

(a) for partitions, for example in indoor environments;

(b) for wall studding;

(c) for interior windowsills, optionally also for exterior windowsills;

(d) for interior skirting boards at circa floor level within indoor rooms;

(e) ceiling panels, for example suspended ceiling panels as a replacement for convention foam or plaster board panels employed to construct suspended ceilings;

(f) for temporary accommodation, for example for emergency shelters to be constructed from flat-pack kits including the fibreboard panels pursuant to the present disclosure that have a peripheral profile that can be mutually slotted together and/or bolted together to construct such emergency shelters (for example, relevant to United Nations emergency relief in disaster zones).

Beneficially, off-cuts of fibreboard from (a) to (f) above can be used as anti-shock inserts in product packaging, thermal insulation panels and so forth.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A process of manufacturing a construction board from a waste material, wherein the process comprises:

pulping at least a portion of the waste material and corrugated waste material with water to obtain a waste pulp;

refining at least a portion of the waste material into microfibrillated cellulose (MFC), using a mechanical micro-fibrillation process, wherein the MFC provides binding for manufacturing the construction board without inclusion of added chemical binding agents;

dispersing the MFC into the waste pulp to obtain a micro-fibrillated waste pulp;

moulding the micro-fibrillated waste pulp by applying a moulded vacuum pressure to obtain a moulded construction board, using a continuous moulding process, wherein the continuous moulding process further comprising a first step of applying a first pressure and a second step of applying a second pressure, wherein the second pressure is greater than the first pressure; and drying the moulded construction board using a multi-stage drying process comprising a plurality of temperature stages to obtain the construction board with a Modulus of Elasticity in a range of 3700 to 3950 megapascals (MPa) and a tensile force in a range of 322.4 to 342 Newton per 20 mm.

2. The process of claim 1, wherein the refining includes additionally using one or more enzymes to perform at least one of: treating the waste, modifying a surface structure of the micro-fibrillated cellulose and other types of fibres present obtained from the waste, selectively removing mutually different types of fibres from the waste.

3. The process of claim 1, wherein the process further comprises filtering the waste material to remove contaminants therefrom before pulping the waste material.

4. The process of claim 1, wherein mechanical microfibrillation process further comprises:

pulping the corrugated waste material to obtain a first solid waste pulp having a solid consistency in a range of 9 percent to 30 percent;

diluting the first solid waste pulp with water to obtain a second solid waste pulp having a solid consistency in a range of 3.5 percent to 6 percent;

providing the second solid waste pulp to a refiner, wherein the refiner comprises a first chamber and a second chamber that are mutually connected through an in-line mixing chamber;

pumping the second solid waste pulp into the first chamber and processing the second solid waste pulp in the in-line mixing chamber before passing the processed second solid waste pulp into the second chamber; and using the refiner to fibrillate the processed second solid waste pulp, and separate the fibres into strands and fibrillar elements to obtain the microfibrillated cellulose (MFC).

5. The process of claim 1, wherein the waste material is pulped with the water to ensure complete dispersion for a time period in a range of 5 minutes to 60 minutes in order to obtain the waste pulp.

6. The process of claim 1, wherein the process further comprises adding at least one additive along with the micro-fibrillated cellulose while dispersing the micro-fibrillated cellulose into the waste pulp.

7. The process of claim 1, wherein the process further comprises recycling the construction board after usage.

* * * * *